US007892001B2

(12) United States Patent
Hanyu

(10) Patent No.: US 7,892,001 B2
(45) Date of Patent: Feb. 22, 2011

(54) FLOATING CONNECTOR

(75) Inventor: Takuji Hanyu, Tokyo (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/597,206

(22) PCT Filed: Apr. 23, 2008

(86) PCT No.: PCT/US2008/005205

§ 371 (c)(1),
(2), (4) Date: Jan. 29, 2010

(87) PCT Pub. No.: WO2008/133890

PCT Pub. Date: Nov. 6, 2008

(65) Prior Publication Data

US 2010/0130058 A1 May 27, 2010

(30) Foreign Application Priority Data

Apr. 23, 2007 (JP) ..... 2007-112934

(51) Int. Cl.
*H01R 13/64* (2006.01)

(52) U.S. Cl. ..... 439/247; 439/65; 439/67; 439/498

(58) Field of Classification Search ..... 439/65, 439/67, 247, 498, 248, 77
See application file for complete search history.

(56) References Cited

U.S. PATENT DOCUMENTS

| | | | | |
|---|---|---|---|---|
| 5,112,234 | A | 5/1992 | Johnson et al. | |
| 6,247,971 | B1 * | 6/2001 | Lim | 439/620.04 |
| 7,404,726 | B1 * | 7/2008 | Herring et al. | 439/246 |
| 7,500,862 | B1 * | 3/2009 | Herring et al. | 439/246 |

FOREIGN PATENT DOCUMENTS

| | | |
|---|---|---|
| EP | 0 571 879 A2 | 12/1993 |
| JP | 07-326443 | 12/1995 |

OTHER PUBLICATIONS

International Search Report for PCT/US08/05205.

* cited by examiner

*Primary Examiner*—Gary F. Paumen
(74) *Attorney, Agent, or Firm*—Timothy M. Morella

(57) ABSTRACT

A floating connector that utilizes multiple cables or ribbon cable is described, the connector has two termination ends, each with a housing and conductive terminals. The housings have a stepped configuration having at least two different levels on which free ends of the cables are terminated to the terminals of the housing. The terminals extend from the steps to terminating faces that are mate with opposing receptacle connectors. The two housing are flexibly interconnected so that they may deflect relative to each other.

6 Claims, 8 Drawing Sheets

FIG.12
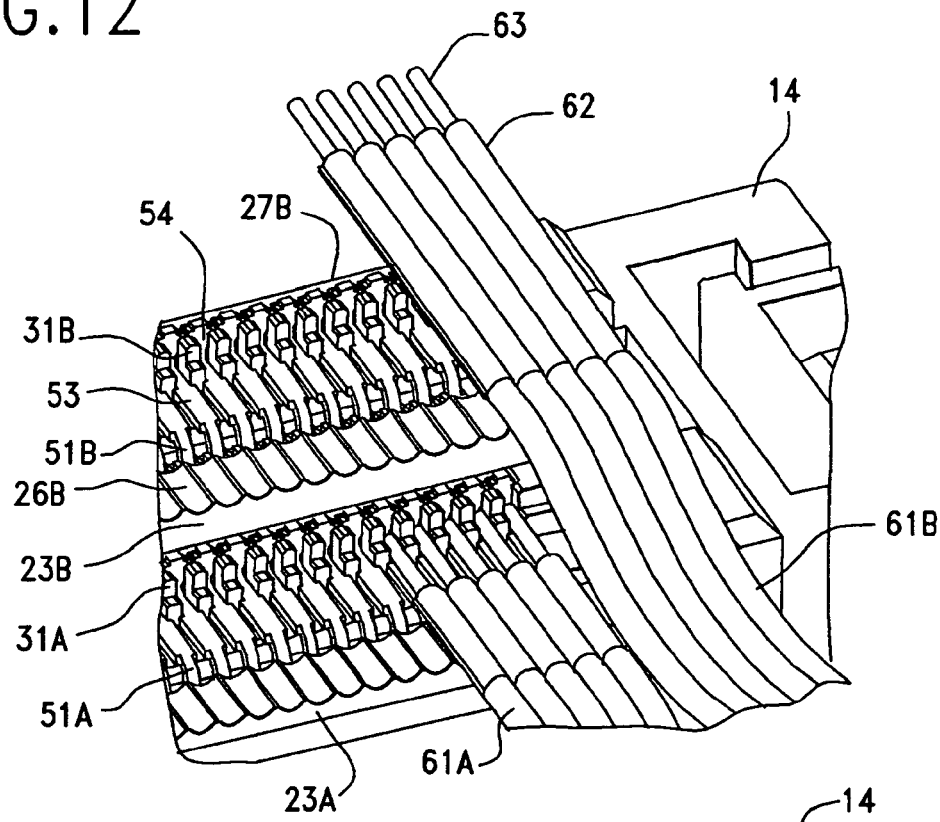
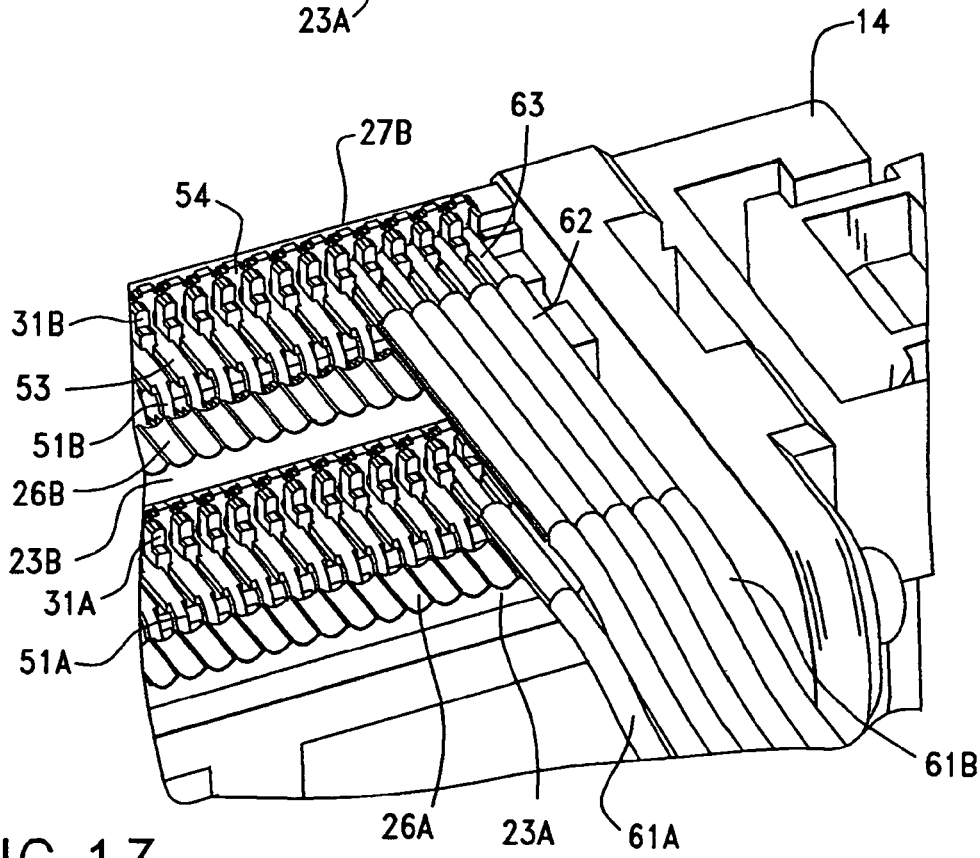
FIG.13

FLOATING CONNECTOR

BACKGROUND OF THE INVENTION

The present invention relates to a floating connector.

Conventionally, in order to connect a pair of parallel circuit boards to each other, a cable connector is used (for example, refer to Japanese Patent Application Laid-Open Publication (Kokai) No. 7-326443). The cable connector mentioned above connects a pair of circuit boards arranged side by side in the same plane by cables.

FIG. 14 is a side elevational view of a conventional cable connector.

In the drawing 901 denotes a plug connector mounted on one substrate 891, which has a plug housing 911, and a plurality of plug modules 950 attached to the plug housing 911. In this case, a plurality of terminals 951 connected to conductive traces (not shown) of the substrate 891 are attached to each of the plug modules 950. The plug terminals 951 extend vertically direction to the substrate 891.

801 denotes a jack connector fitted to the plug connector 901, which has a plurality of L-shaped jack modules 821. In this case, a plurality of jack terminals 851 engage the plug terminals 951 and are attached to each of the jack modules 821. The jack terminals 851 are L-shaped form in the same manner as the jack modules 821, and one end of each cable 861 is connected to portions extending in a direction parallel to the substrate 891.

In this case, the other ends (not shown) of the cables 861 are connected to jack terminals 851 attached to jack modules 821 of another jack connector 801, in the same manner. Further, another jack connector 801 is fitted to another plug connector 901 mounted to another substrate 891 (not shown). Accordingly, since the jack terminals 851 of the another jack connector 801 are engaged with the plug terminals 951 of the another plug connector 901, both the substrates 891 are connected to each other via the plug connector 901, the jack connector 801 and the cables 861.

If a displacement is generated between both the substrates 891 when connecting to each other by the connectors mentioned above, each cable 861 acts separately and is flexible and can be easily deflected. Accordingly, it is possible to suitably absorb the displacement.

However, in this conventional connector it is necessary to solder the cables 861 one by one to the jack terminals 851. This takes a lot of effort and time to connect the cables 861 and the cost becomes high. A ribbon cable or the like may be used. However, because it is necessary to individually position each cable 861 and its core wire with respect to each jack terminal 851, it takes a lot of effort and time to connect the cables 861 and the cost becomes high.

Further, since the jack modules 821 are used, the number of parts is increased and the structure becomes complicated.

SUMMARY OF THE INVENTION

An object, therefore, of the present invention is to provide a floating connector which solves the conventional problems mentioned above, and one that can connect a plurality of sets of cables in an overlapping state by forming a plurality of rows of terminals having a crank shape, arranging the terminals so as to generate a height difference between the rows, forming a plurality of rows of concave portions supporting coating members of the respective cables so as to be adjacent to the terminals, and arranging the concave portions so as to generate a height difference between the rows, can collectively position a plurality of cables in each of the sets so as to connect to the corresponding terminals, can connect the cables easily and for a short time, can form a simple structure by a reduced number of parts, and has a low cost and a high reliability.

Accordingly, in accordance with the present invention, there is provided a floating connector comprising: a pair of housings, each a set of terminals and which are adapted to be fitted to a counterpart connector. There is a plurality of cables that connect the terminals of one housing to the terminals of the other housing, and a connector holder, flexibly coupling the two housings together wherein each terminal includes a contact portion that contacts with a counterpart terminal provided in the counterpart connector, a connection portion having one end connected to an upper end of the contact portion to which a wire of the cable is connected, and a rising portion having a lower end connected to the other end of the connection portion and against which a leading end of the core wire is brought into abutment, the terminals of each set are aligned widthwise of the housing, the connection portions of the terminals of the adjacent sets have a height difference formed there between; the housing includes a plurality of sets of cable support portions formed at positions adjacent to the connection portions of the terminals of the respective sets, and a plurality of concave portions formed on upper surfaces of the cable support portions of each set, aligned in the width direction of the housing, and accommodating the coating members of the cables; and the cable includes a portion in a predetermined length range from an end of the cable in which the coating member is removed and the core wire is exposed, the cables of each set are aligned in the width direction of the housing, the cables of the adjacent sets are arranged at vertically different positions, portions of the coating members adjacent to the core wires of the exposed portions are accommodated in the concave portions and positioned in the width direction of the housing, the leading ends of the core wires of the exposed portions are brought into abutment against the rising portion and positioned in an axial direction, and the core wires of the exposed portions are connected to the connection portions.

In another floating connector in accordance with the present invention, the housing includes a rising wall portion formed in an upper end thereof, and a plurality of positioning concave portions formed in the rising wall portion, the rising portion of each of the terminals is accommodated in the positioning concave portion and supported by the rising wall portion, and the leading end of the core wire of each of the cables is accommodated in the positioning concave portion and positioned in the width direction of the housing.

In a further floating connector in accordance with the present invention the cables include a ribbon cable in which the adjacent cables in the set are connected to each other.

In a further floating connector in accordance with the present invention, each terminal set is arranged such that the positions of the adjacent sets are different in the axial direction of the cable.

In a still further floating connector in accordance with the present invention, the connector holder includes a first top plate portion covering an upper side of the one housing, a second top plate portion separated from the first top plate portion and covering an upper side of the other housing, coupling side wall portions connected at their ends to distal ends of the first top plate portion and the second top plate portion, and holding lug portions connected to proximal ends of the first top plate portion and the second top plate portion and holding the housing.

In a still further floating connector in accordance with the present invention, the housings are provided holding wall portions formed in both sides in the width direction, and holding projections formed in the holding wall portions, the connector holder is provided with an engagement openings formed in the holding lug portions, the holding lug portions sandwich the holding wall portions, and the engagement openings are engaged with the holding projection.

In accordance with the present invention, the floating connector is structured such that a plurality of rows of terminals having a crank or a "stepped" shape are formed and arranged so as to have a height difference between the rows, and a plurality of rows of concave portions supporting the coating members of the respective cables are formed adjacent to the respective terminals and are arranged so as to have a height difference between the rows. Accordingly, it is possible to connect a plurality of sets of cables in the overlapping state, it is possible to collectively position a plurality of cables in each of the sets so as to connect to the corresponding terminals, it is possible to easily connect the cables for a short time, it is possible to reduce the cost, and it is possible to improve the reliability.

BRIEF DESCRIPTION OF THE DRAWINGS

FIG. 12 is a third, sequential view of FIG. 10, illustrating the orienting of a second row of cables;

FIG. 13 is a fourth, sequential view of FIG. 10, illustrating the operation for connecting of the second row of cables.

DESCRIPTION OF THE PREFERRED EMBODIMENTS

Figure 1:
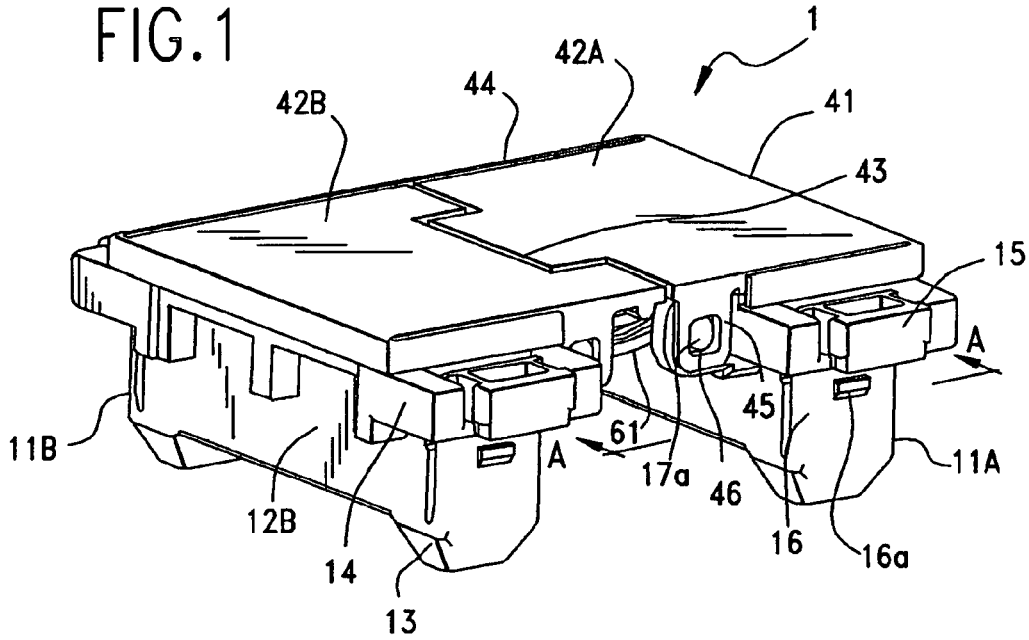
FIG. 1 is a perspective view of a floating connector constructed in accordance with the present invention.

Preferred embodiments of the present invention will be described below in detail with reference to the accompanying drawings.

In the drawings, reference numeral 1 denotes a floating connector in accordance with the present embodiment. The floating connector 1 has a first housing 11A and a second housing 11B formed by an insulating material such as a synthetic resin or the like, has a connector holder 41 holding the first housing 11A and the second housing 11B, and can electrically connect a first substrate 91A and a second substrate 91B which are mentioned below, by fitting the first housing 11A and the second housing 11B to a first counterpart connector 101A and a second counterpart connector 1018 which are respectively mounted on the first substrate 91A and the second substrate 91B.

The connector holder 41 includes a rectangular plate-like member formed by an insulating material, and has a first top plate portion 42A covering the upper side of the first housing 11A, a second top plate portion 42B covering the upper side of the second housing 11B, and a pair of coupling side wall portions 44 extending in the longitudinal direction of the connector holder 41 and coupling the first top plate portion 42A and the second top plate portion 42B. Further, the first top plate portion 42A and the second top plate portion 42B have holding lug portions 45 integrally connected thereto, the holding lug portions 45 having engagement openings 46 formed there through for engaging with holding projections 17*a* provided in the first housing 11A and the second housing 11B for holding them. The holding lug portions 45 are connected to the first top plate portion 42A and the second top plate portion 42B at proximal ends of the first top plate portion 42A and the second top plate portion 42B, that is, ends thereof close to the center of the connector holder 41 in the longitudinal direction in such a manner that they extend downward from both side edges of the first top plate portion 42A and the second top plate portion 42B.

Figure 3:
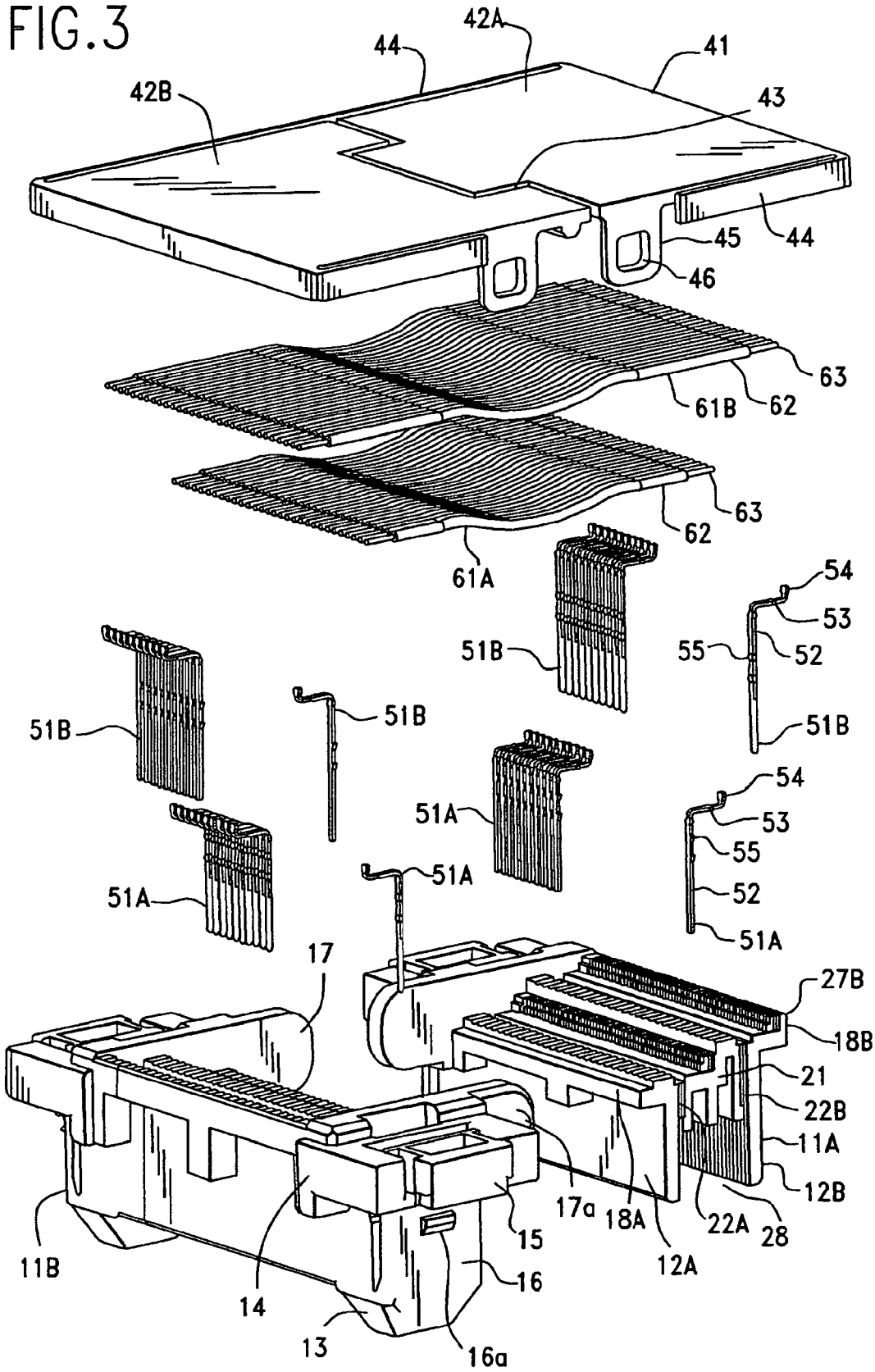
FIG. 3 is an exploded view of the floating connector of FIG. 1.
Figure 4:
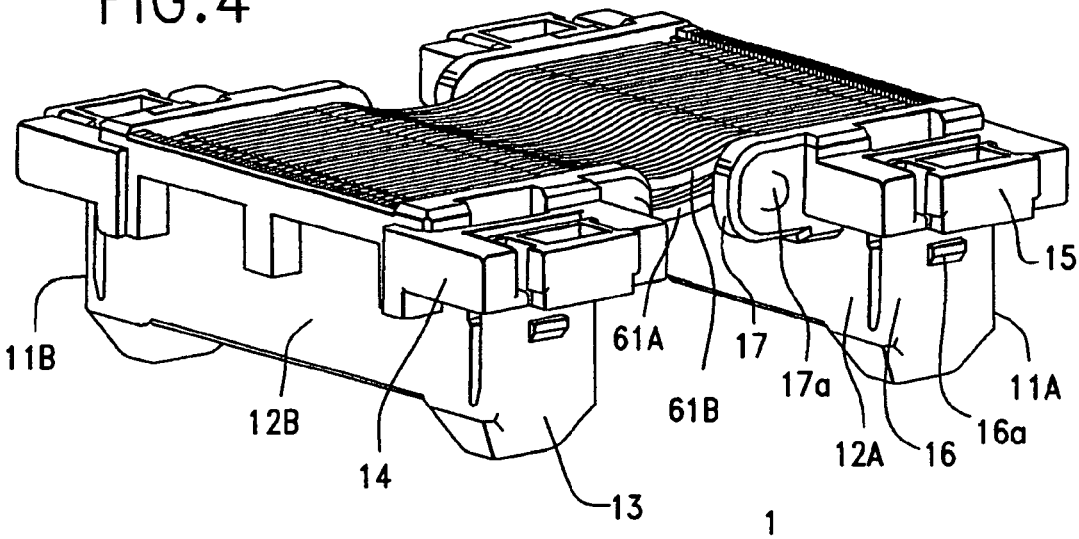
FIG. 4 is a perspective view of the floating connector of FIG. 1 with the connector holder is removed.

In this case, the first top plate portion 42A and the second top plate portion 42B are separated from each other by a slit-like separation groove 43 passing through the plate-like member in the thickness direction (vertical direction in FIGS. 1 and 3). Further, the separation groove 43 extends longitudinally in the connector holder 41 along both sides of the first top plate portion 42A and the second top plate portion 42B, and separates the first and second top plate portions 42A and 42B and the coupling side wall portions 44 positioned on both sides of the first and second top plate portions 42A and 42B from each other. Further, the separation groove 43 terminates at positions near both ends of the connector holder 41 in the longitudinal direction, whereby the first top plate portion 42A and the second top plate portion 42B are connected, at the end portions of the connector holder 41 i.e., to both end portions of the coupling side wall portion 44 in the longitudinal direction. In other words, the first top plate portion 42A and the second top plate portion 42B are coupled to each other by a pair of elongated coupling side wall portions 44 so that both side edges of the first top plate portion 42A and the second top plate portion 42B are connected to, both longitudinal ends of the connector holder 41 and to both ends of the coupling side wall portions 44.

The connector holder 41 achieves a certain degree of flexibility by being provided with the shape mentioned above. Particularly, since the distance of a portion connecting the holding lug portions 45 connected to the first top plate portion 42A and the holding lug portions 45 connected to the second top plate portion 42B becomes longer, an allowable amount of a relative displacement between the holding lug portions 45 connected to the first top plate portion 42A and the holding lug portions 45 connected to the second top plate portion 42B is enlarged. Accordingly, since the allowable a relative displacement between the first housing 11A held by the holding lug portions 45 connected to the first top plate portion 42A, and the second housing 11B held by the holding lug portions 45 connected to the second top plate portion 42B is enlarged, it is possible to maintain connection between the first and second housings 11A and 11B and first and second counterpart connectors 101A and 101B even if the displacement between the first substrate 91A and the second substrate 91B increases.

In this case, in FIGS. 1 and 3, a part of the coupling side wall portion 44 positioned on the near side in the drawing is removed for clarity for viewing the shape of the holding lug portions 45, and this part is not cut away actually in the invention.

Terminals 51 are aligned and loaded in the first housing 11A and the second housing 11B in such a manner as to form a row extending in the width direction. In this case, a plurality of rows of the terminals 51 are provided, and the description will be given of the present embodiment on the assumption that two rows of terminals are provided. Further, the terminals 51 forming the inner row in the first housing 11A and the second housing 11B which are arranged in parallel to each other correspond to first terminals 51A, and the terminals 51 forming the outer row correspond to second terminals 51B. In this case, since the numbers of the first terminals 51A and the second terminals 51B are large, several terminals in the actual first terminals 51A and second terminals 51B are drawn, and the others are omitted, as a matter of convenience for illustration in the embodiment shown in FIG. 3. Further, the first terminal 51A and the second terminal 51B are described as the terminal 51 in the case of being described in an integrative manner.

Further, the first terminals 51A of the first housing 11A and the first terminals 51A of the second housing 11B are connected to each other via first cables 61A, and the second terminals 51B of the first housing 11A and the second terminals 51B of the second housing 11B are connected to each other via second cables 61B. The first cable 61A and the second cable 61B are constituted by a so-called lead wire obtained by coating a coating member 62 made of an insulating material such as synthetic resin or the like around a core wire 63 made of a conductive metal or the like, and the coating member 62 is removed in such a manner that the core wire 63 is exposed at a predetermined length range. In this case, the first cable 61A and the second cable 61B are arranged so that the cables are parallel, and the adjacent cables are connected to each other as in a so-called ribbon cable. In this case, the first cable 61A and the second cable 61B have substantially the same structure, and are described generally as a cable 61.

Figure 2:
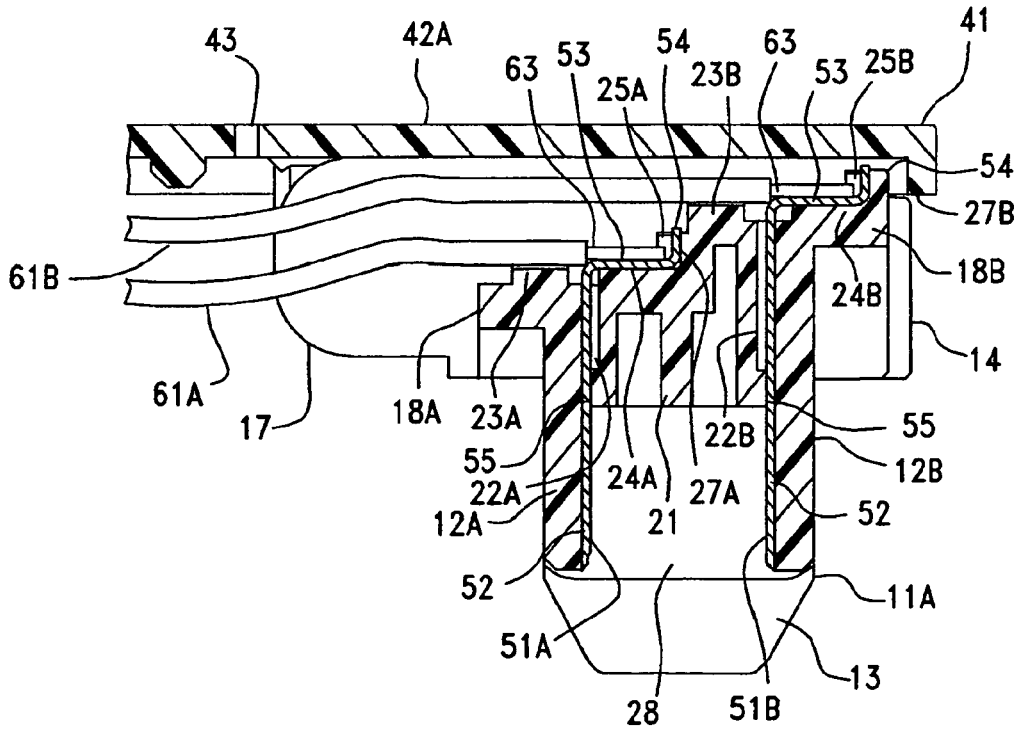
FIG. 2 is a cross-sectional view of the floating connector of FIG. 1, taken along line A-A thereof.

The first terminal 51A and the second terminal 51B are constituted by an elongated rod-like member made of the conductive metal or the like, and are formed in such a manner as to be formed in a crank-shaped form as a whole, as shown in FIGS. 2 and 3. Further, each of the first terminal 51A and the second terminal 51B are provided with a contact portion 52 extending in a vertical direction, a connection portion 53 connected, at its one end, to the upper end of the contact portion 52 and extending in a direction orthogonal to the contact portion 52, and a rising portion 54 connected, at its lower end, to the other end of the connection portion 53 and extending in the vertical direction. Further, a plurality of fixing projections 55 are formed in the contact portion 52. In this case, the structures of the first and second terminals 51A, 51B are approximately the same, but are different in that the length of the contact portion 52 of the second terminal 51B is longer, and that the direction in which the fixing projections 55 protrude is different between the first and second terminals 51A, 51B.

The housing 11 is provided with a first outer wall portion 12A and a second outer wall portion 12B extending widthwise, an intermediate wall portion 21 extending widthwise, and a pair of side wall portions 13 arranged in both ends widthwise, and integrally connected to end portions of the first and second outer wall portions 12A, 12B and the intermediate wall portion 21. The first and second outer wall portions 12A, 12B oppose each other, and are structured so that the intermediate wall portion 21 is sandwiched there between. In this case, the lower end edge of the first outer wall portion 12A and the lower end edge of the second outer wall portion 12B are positioned at the same height. However, the lower end edge of the intermediate wall portion 21 exists at a higher elevation than the lower end edges of the first outer wall portion 12A and the second outer wall portion 12B. Accordingly, a fitting concave portion 28 serving as a concave portion sandwiched by the first outer wall portion 12A and the second outer wall portion 12B is formed on the lower side of the intermediate wall portion 21. In this case, the lower end edges of the side wall portions 13 on both sides exist at a lower position than the lower end edges of the first outer wall portion 12A and the second outer wall portion 12B.

Further, a first canopy top portion 18A extending toward the inner side is connected to the upper end edge of the first outer wall portion 12A, and a first cable support portion 23A supporting end portions of portions covered by the coating members 62 of the first cables 61A is formed in the upper surface of the first canopy top portion 18A. Further, a second canopy top portion 18B extending toward the outer side is connected to the upper end edge of the second outer wall portion 12B, the upper surface of the second canopy top portion 18B serves as a second terminal support portion 24B supporting the connection portions 53 of the second terminals 51B, and a second rising wall portion 27B supporting the rising portion 54 of the second terminal 51B is formed in the outer end of the upper surface of the second canopy top portion 18B. In this case, the upper end edge of the second outer wall portion 12B exists at a higher position than the upper end edge of the first outer wall portion 12A. Accordingly, a height difference is generated between the upper surface of the first canopy top portion 18A and the upper surface of the second canopy top portion 18B, the upper surface of the first canopy top portion 18A is positioned in the lower stage, and the upper surface of the second canopy top portion 18B is positioned in the upper stage.

Further, in the upper end of the intermediate wall portion 21, a height difference corresponding to the height difference between the upper surface of the first canopy top portion 18A and the upper surface of the second canopy top portion 18B is formed. In the upper end of the intermediate wall portion 21, the upper surface of the portion close to the inner side, that is, close to the first canopy top portion 18A exists at a height close to the upper surface of the first canopy top portion 18A, that is, the first cable support portion 23A, and serves as a first terminal support portion 24A supporting the connection portions 53 of the first terminals 51A. Further, the upper surface of the portion close to the outer side, that is, close to the second canopy top portion 18B exists at a height close to the upper surface of the second canopy top portion 18B, that is, the second terminal support portion 24B, and a second cable support portion 23B supporting the end portions of the portions covered by the coating members 62 of the second cables 61B is formed. Further, a height difference portion (vertical portion) in the boundary between the upper surface of the portion close to the first canopy top portion 18A and the upper surface of the portion close to the second canopy top portion 18B serves as a first rising wall portion 27A supporting the rising portions 54 of the first terminals 51A.

Further, a first loading opening 22A extends vertically and is formed in the boundary between the first outer wall portion 12A and the intermediate wall portion 21, and a second loading opening 22B extend vertically and is formed in the boundary between the second outer wall portion 12B and the intermediate wall portion 21. The first loading opening 22A is formed to extend from the upper end of the intermediate wall portion 21 to the lower end, and the contact portion 52 of the first terminal 51A is inserted to be fixed. In this case, the fixing projection 55 formed in the contact portion 52 skives into the inner side wall of the first loading opening 22A, whereby the contact portion 52 is fixed. Further, the second loading opening 22B is formed to extend from the upper end of the intermediate wall portion 21 to the lower end, and the contact portion 52 of the second terminal 51B is inserted to be fixed. Further, the fixing projection 55 formed in the contact portion 52 skives into the inner side wall of the second loading opening 22B, whereby the contact portion 52 is fixed.

In this case regard, each of the first and second loading openings 22A, 22B are formed as an elongated slit-shaped continuous single opening extending in the width direction of the housing 11. However, they may be divided into a plurality of sections in widthwise in the housing 11. Each of the first and second loading openings 22A, 22B may be structured such that a plurality of small independent openings are formed in correspondence to every one of the first terminals 51A and the second terminals 51B, or may be structured such that a plurality of comparatively large openings are formed so as to insert a group constituted by a plurality of first terminals 51A and second terminals 51B thereto.

Further, in the first terminal 51A, the contact portion 52 is inserted to the first loading opening 22A from the upper side, and the lower surface of the connection portion 53 is brought into contact with the first terminal support portion 24A so as to be supported. In this case, the outer surface of the rising portion 54 is brought into contact with the first rising wall portion 27A so as to be supported, and the inner side surface of the contact portion 52 is brought into contact with the first outer wall portion 12A so as to be supported. Further, the position of the lower end of the contact portion 52 comes to approximately the same height as the lower end edge of the first outer wall portion 12A, and the lower portion than the lower end edge of the intermediate wall portion 21 of the contact portion 52 is exposed into the fitting concave portion 28, and comes into contact with a counterpart contact portion 152 of a counterpart terminal 151 mentioned below provided in the counterpart connector 101. In this case, in the first rising wall portion 27A, there is formed a first core wire positioning concave portion 25A serving as a positioning concave portion in which a leading end of the core wire 63 of the first cable 61A is accommodated, and the rising portion 54 of each of the first terminals 51A is accommodated within the first core wire positioning concave portion 25A.

Further, in the second terminal 51B, the contact portion 52 is inserted to the second loading opening 22B from the upper side, and the lower surface of the connection portion 53 is brought into contact with the second terminal support portion 24B so as to be supported. In this case, the outer side surface of the rising portion 54 is brought into contact with the second rising wall portion 27B so as to be supported, and the outer side surface of the contact portion 52 is brought into contact with the second outer wall portion 12B so as to be supported. Further, the position of the lower end of the contact portion 52 is approximately at the same height as the lower end edge of the second outer wall portion 12B, and the lower portion than the lower end edge of the intermediate wall portion 21 of the contact portion 52 is exposed into the fitting concave portion 28, and comes into contact with the counterpart contact portion 152 of the counterpart terminal 151 mentioned below provided in the counterpart connector 101. In this case, in the second rising wall portion 27B, there is formed a second core wire positioning concave portion 25B serving as a positioning concave portion in which a leading end of a core wire 63 of the second cable 61B is accommodated, and the rising portion 54 of each of the second terminals 51B is accommodated within the second core wire positioning concave portion 25B.

Both ends of the first cable 61A are connected to the connection portions 53 of the corresponding first terminals 51A. In this case, in both ends of the first cable 61A, the core wire 63 in which the coating member 62 is removed so as to be exposed is mounted to the connection portion 53, and is firmly fixed to the connection portion 53 by a fixing means such as a soldering or the like so as to be connected. In this case, the coating of the core wire 63 is removed so as to be exposed at the same length as a flat portion of the connection portion 53 or somewhat longer.

Further, an end portion of the portion covered by the coating member 62, that is, an adjacent portion of the exposed core wire 63 is mounted on the first cable support portion 23A, and is supported by the first cable support portion 23A. In this case, first coating positioning concave portions 26A mentioned below are formed in the first cable support portion 23A, and the end portion of the portion covered by the coating member 62 is accommodated within the first coating positioning concave portion 26A, whereby the first cable 61A is positioned with respect to the width direction of the housing 11. Further, the first cable 61A is positioned with respect to the axial direction by bringing the leading end of the core wire 63 into abutment against the rising portion 54. Further, the leading end of the core wire 63 is accommodated within the first core wire positioning concave portion 25A, whereby the first cable 61A is positioned with respect to the width direction of the housing 11.

In the same manner, both ends of the second cable 61B are connected to the connection portions 53 of the corresponding second terminals 51B. In this case, in both ends of the second cable 61B, the core wire 63 in which the coating member 62 is removed so as to be exposed, is mounted on the connection portion 53, and is firmly fixed to the connection portion 53 by the fixing means such as the soldering or the like so as to be connected. In this case, the coating of the core wire 63 is removed to expose the same length of wire as a flat portion of the connection portion 53 or somewhat longer.

The end of the portion covered by the coating member 62, that is, the adjacent portion of the exposed core wire 63 is mounted on the second cable support portion 23B, and is supported by it. In this case, second coating positioning concave portions 26B mentioned below are formed in the second cable support portion 23B, and the end portion of the portion covered by the coating member 62 is accommodated within the second coating positioning concave portion 26B, whereby the second cable 61B is positioned widthwise on the housing 11. The second cable 61B is positioned axially by bringing the leading end of the core wire 63 into abutment against the rising portion 54. Further, the leading end of the core wire 63 is accommodated within the second core wire positioning concave portion 25B, whereby the second cable 61B is positioned widthwise in the housing 11.

Since the leading end of the core wire 63 is secured accommodated within the first and second core wire positioning concave portions 25A and 25B by bringing the leading end thereof into abutment against the rising portion 54, the core wire 63 does not come into contact with the adjacent core wire 63 even in the leading end portion which tends to be comparatively dispersed its position.

If both the ends of the first cable 61A are connected to the connection portions 53 of the first terminals 51A, and both the ends of the second cable 61B are connected to the connection portions 53 of the second terminals 51B, the height difference exists in the upper end of the housing 11, the connection portion 53 of the first terminal 51A is positioned in the lower stage, and the connection portion 53 of the second terminal 51B is positioned in the upper stage. As shown in FIG. 2, the first cable 61A and the second cable 61B are separated into upper and lower stages, and are not interfered with each other. Therefore, it is possible to divide many cables 61 into the upper and lower stages, and it is possible to reduce the width of the housing 11 so as to narrow a private area of the floating connector 1.

Further, a holding wall portion 17 (to be held) extending toward the center of the connector holder 41 in the longitudinal direction is integrally connected to the upper end of the side wall portion 13. The holding projection 17*a* protruding toward the outer side of the housing 11 in the width direction is integrally formed near the leading end of the holding wall portion 17, and the holding projection 17*a* is engaged with the engagement opening 46 formed in the holding lug portion 45 of the connector holder 41. In this case, the holding wall portions 17 positioned on both sides of the housing 11 in the width direction are sandwiched from the outer side by the holding lug portions 45 of the connector holder 41, and the holding projections 17*a* are engaged in the engagement openings 46, whereby the housing 11 is securely held by the connector holder 41.

Further, the respectively independent first and second housings 11A, 11B are held by the connector holder 41, thereby coming to a state of being coupled to each other. Accordingly, since the interval between the first housing 11A and the second housing 11B is held constant, the first cables 61A and the second cables 61B in which both ends are connected to the first terminals 51A and the second terminals 51B of the first housing 11A and the second housing 11B are not exposed to a tensile force caused by an expansion of the interval between the first housing 11A and the second housing 11B. Further, since it is possible to integrally handle a whole of the floating connector 1, it is possible to easily execute an operation by a finger or a hand of an operator at a time of fitting the first housing 11A and the second housing 11B to the first counterpart connector 101A and the second counterpart connector 101B respectively mounted to the first substrate 91A and the second substrate 91B.

Further, since the upper side of the terminals 51 and the core wire 63 of the cables 61 is covered by the top plate portion 42, impurities such as dusts or the like in the air do not come down to be attached to the terminal 51 or the core wire 63. Accordingly, it is possible to prevent a short circuit between the adjacent terminals 51 and core wires 63 caused by the attachment of the impurities.

Further, a pair of handling portions 14 protruding outward in the width direction of the housing 11 are integrally formed in each of the holding wall portions 17. The handling portion 14 is a member which the operator grips and operates by the finger, the hand or the like at a time of fitting the housing 11 to the counterpart connector 101, and protrudes to the outer side than the connector holder 41.

Further, lock operation portions 15 which are movable with respect to the handling portions 14 is arranged between a pair of handling portions 14. The lock operation portion 15 is a member which the operator operates by the finger, the hand or the like for canceling the lock at a time of detaching the housing 11 from the counterpart connector 101, and the upper end of the lock member 16 extending in the vertical direction is integrally connected. The lock member 16 is a plate-like member formed in such a manner that the lower end thereof is integrally connected to the lower portion of the side wall portion 13 so as to cover the side surface of the side wall portion 13, and a lock projection 16*a* protruding to the outer side is integrally formed on the outer surface thereof. The lock projection 16*a* is engaged with a counterpart lock protruding portion 113*a* mentioned below of the counterpart connector 101, locks the housing 11 with respect to the counterpart connector 101, and prevents the housing 11 fitted to the counterpart connector 101 from breaking away from the counterpart connector 101.

The lock member 16 is a cantilever-like member having a fixed lower end, and is elastically deformed, whereby the upper end corresponding to a free end displaces so as to come close to the upper end of the side wall portion 13. Accordingly, at a time of canceling the lock, it is possible to displace the lock projection 16*a* toward the center in the width direction of the housing 11 so as to cancel the engagement with the counterpart lock protruding portion 113*a*, by displacing the lock operation portion 15 connected to the upper end of the lock member 16 so as to come close to the upper end of the side wall portion 13, that is, toward the center in the width direction of the housing 11, by the finger, the hand or the like of the operator.

Next, the description will be given of the operation for fitting the housing 11 to the counterpart connector 101.

The first substrate 91A and the second substrate 91B are printed circuit boards. In this case, the first counterpart connector 101A and the second counterpart connector 101B respectively mounted on the first substrate 91A and the second substrate 91B have the same structure with each other, and are described as the counterpart connector 101 in the case of being described in an integrative manner.

The counterpart connector 101 is constituted by a receptacle connector, and has a counterpart housing 111 integrally formed by an insulating material such as synthetic resin or the like, and nails 161 serving as mounting auxiliary brackets attached to both ends of the counterpart housing 111 in the width direction. Further, the counterpart housing 111 has an insertion opening 126 for inserting the housing 11 of the floating connector 1 from the upper side. A plurality of elongated counterpart terminals 151 made of conductive metal or the like are loaded in the insertion opening 126 in correspondence to the layout of the first terminals 51A and the second terminals 51B of the housing 11. In this case, a tail portion 153 of the counterpart terminal 151 is exposed to the lower side of the counterpart housing 111.

The counterpart housing 111 is provided with a first counterpart outer wall portion 112A and a second counterpart outer wall portion 112B extending in the width direction thereof, a fitting convex portion 121 extending in the width direction, and a pair of counterpart side wall portions 113 arranged in both ends in the width direction, and integrally connected to end portions of the first counterpart outer wall portion 112A and the second counterpart outer wall portion 112B. The first counterpart outer wall portion 112A and the second counterpart outer wall portion 112B oppose to each other, the counterpart side wall portions 113 in both sides oppose to each other, the periphery of the insertion opening 126 is defined by the first counterpart outer wall portion 112A, the second counterpart outer wall portion 112B and the counterpart side wall portions 113, and the fitting convex portion 121 is positioned within the insertion opening 126.

Further, the space between the first counterpart outer wall portion 112A and the fitting convex portion 121 serves as a first outer wall portion accommodating concave portion 122A to which the first outer wall portion 12A of the housing 11 is inserted. Further, the space between the second counterpart outer wall portion 112B and the fitting convex portion 121 serves as a second outer wall portion accommodating concave portion 122B to which the second outer wall portion 12B of the housing 11 is inserted. Further, the space between the counterpart side wall portions 113 in both sides and the fitting convex portion 121 serves as a side wall portion accommodating concave portion 115 to which the side wall portion 13 of the housing 11 is inserted.

Further, a plurality of terminal accommodating grooves 123 extending in the vertical direction are formed in the surface opposing to the first counterpart outer wall portion 112A and the surface opposing to the second counterpart outer wall portion 112B in the fitting convex portion 121. The terminal accommodating grooves 123 are formed corresponding to the arrangement of the first and second terminals 51A, 51B in the housing 11, and a body portion 154 of each of the counterpart terminals 151 is accommodated and fixed within each of the terminal accommodating grooves 123. The counterpart contact portion 152 connected to the upper end of the body portion 154 is inclined with respect to the body portion 154, and a leading end, that is, a free end thereof protrudes from the terminal accommodating groove 123 toward the first counterpart outer wall portion 112A and the second counterpart outer wall portion 112B. Accordingly, on the basis of a spring characteristic provided in the counterpart terminal 151 itself, the counterpart contact portions 152 are pressed against the contact portions 52 of the first terminal 51A and the second terminal 51B, and securely comes into contact.

In this case, the tail portions 153 connected to the upper ends of the body portions 154 are exposed to the lower side of the counterpart housing 111, and the lower surfaces thereof are connected to connection pads, a conductive trace or the like which are formed on the surfaces of the first substrate 91A and the second substrate 91B and are not illustrated, by a fixing means such as the soldering or the like. Further, the lower surface of the nail 161 is also connected to the connection pad or the like (not shown) formed on the surfaces of the first substrate 91A and the second substrate 91B by the fixing means such as the soldering or the like. Accordingly, the first counterpart connector 101A and the second counterpart connector 101B are securely fixed to the surfaces of the first substrate 91A and the second substrate 91B.

Further, the counterpart lock protruding portion 113*a* is formed in the surface opposing to the fitting convex portion 121 of the counterpart side wall portion 113. The counterpart lock protruding portion 113*a* is engaged with the lock projection 16*a* of the housing 11, locks the housing 11 with respect to the counterpart connector 101, and prevents the housing 11 fitted to the counterpart connector 101 from breaking away from the counterpart connector 101.

Figure 5:
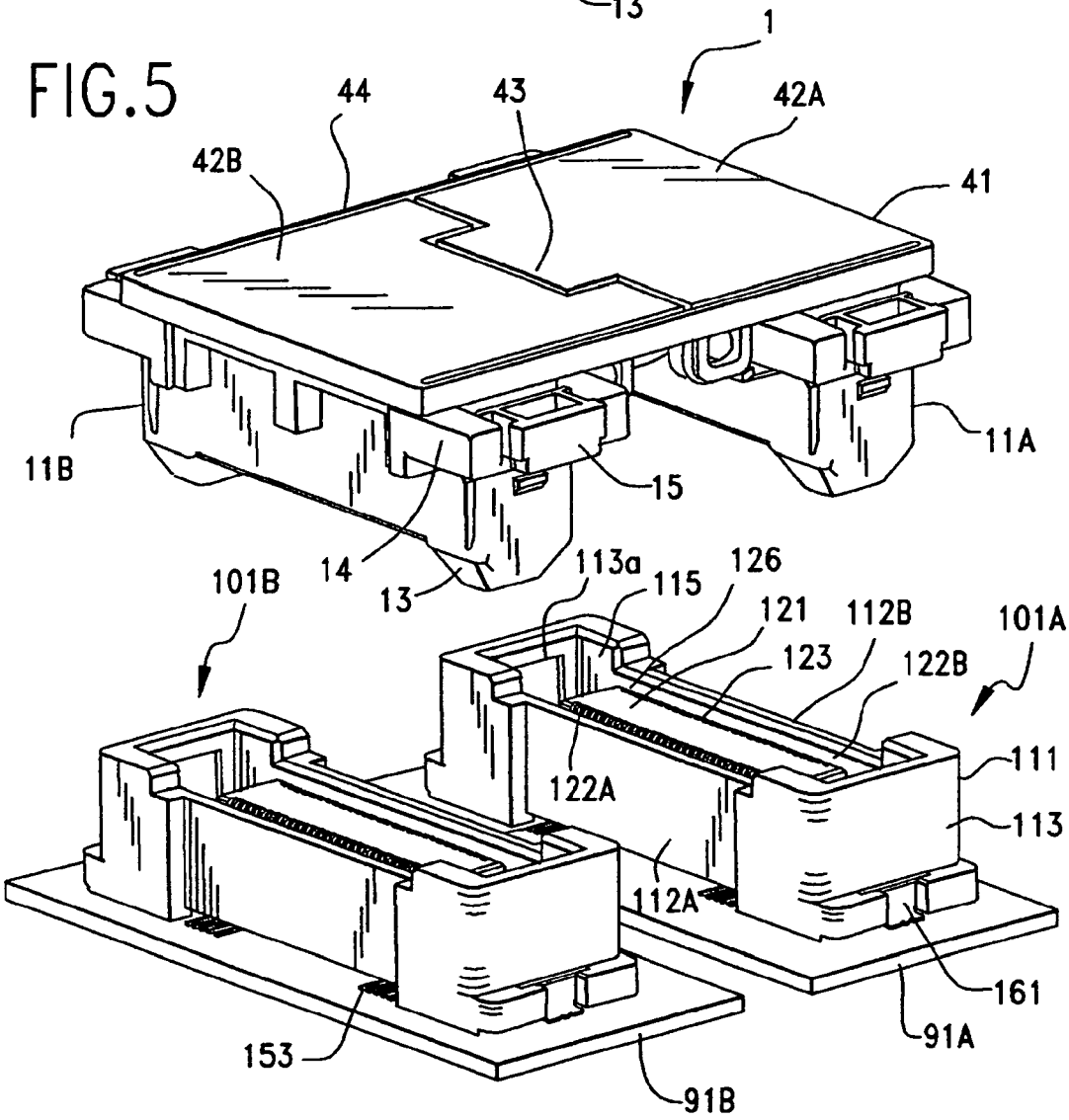
FIG. 5 is a perspective view of the floating connector of FIG. 1 and a counterpart connector before they are fitted together.

In the case of fitting the housing 11 of the floating connector 1 to the counterpart connector 101, the operator first grips the floating connector 1 by the finger, the hand or the like, as shown in FIG. 5, and positions above the first substrate 91A and the second substrate 91B. In this case, the position of the floating connector 1 is controlled in such a manner that each of the housings 11 is positioned just above the corresponding counterpart connector 101. In this case, since the first and second housing 11A,11B are provided with the same structure with each other, and the first counterpart connector 101A and the second counterpart connector 101B are provided with the same structure with each other, it is possible to fit the first housing 11A in the second counterpart connector 101B, and the second housing 11B in the first counterpart connector 101A, however, in this case, the description will be given of the case that the first housing 11A is fitted in the first counterpart connector 101A, and the second housing 11B is fitted in the second counterpart connector 101B.

Subsequently, the floating connector 1 is moved down, the first housing 11A is fitted in the first counterpart connector 101A, and the second housing 11B is fitted in the second counterpart connector 101B. In this case, the first outer wall portion 12A of the housing 11 is inserted into the first outer wall portion accommodating concave portion 122A of the counterpart connector 101, the second outer wall portion 12B of the housing 11 is inserted into the second outer wall portion accommodating concave portion 122B of the counterpart connector 101, and the side wall portions 13 of the housing 11 is inserted into the side wall portion accommodating concave portion 115 of the counterpart connector 101.

As mentioned above, since a pair of housings 11 are held and coupled by the connector holder 41 at a time of fitting the housing 11 of the floating connector 1 to the counterpart connector 101, it is possible to integrally handle a whole of the floating connector 1. Accordingly, the operator can easily execute the operation for fitting the housing 11 to the counterpart connector 101 by the finger, the hand or the like.

Figure 6:
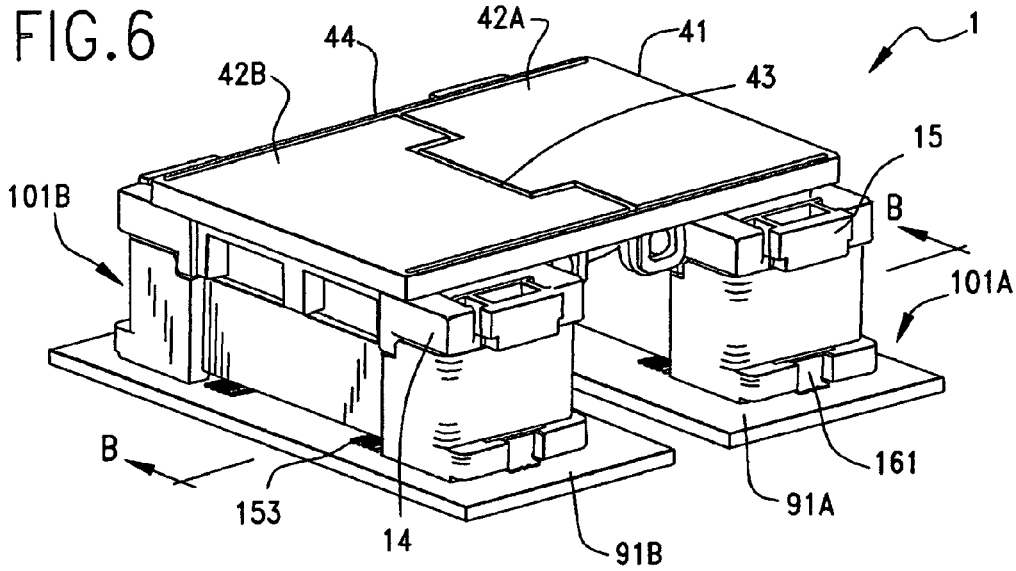
FIG. 6 is the same view of FIG. 1 but with the two connectors fitted together.
Figure 7:
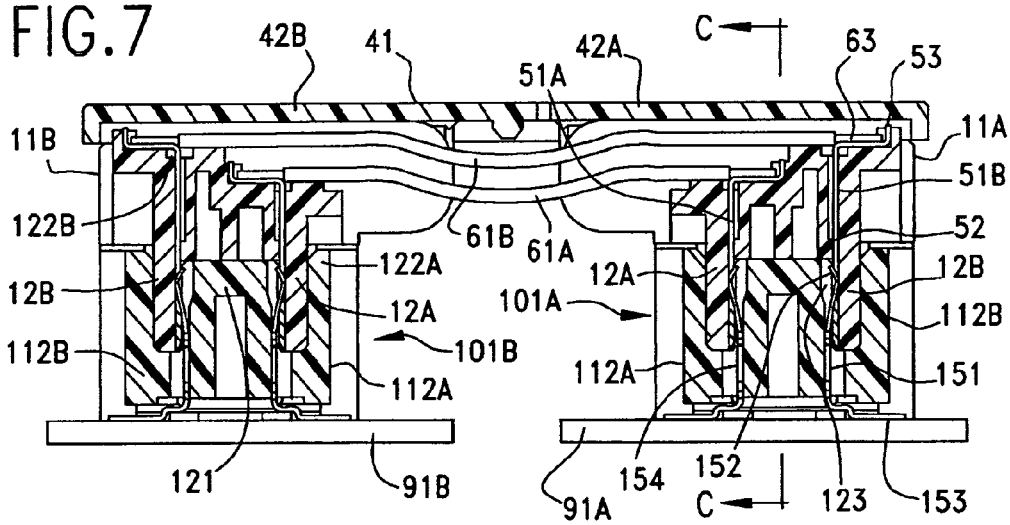
FIG. 7 is a cross sectional view of the two connectors of FIG. 6, taken along line B-B thereof.
Figure 8:
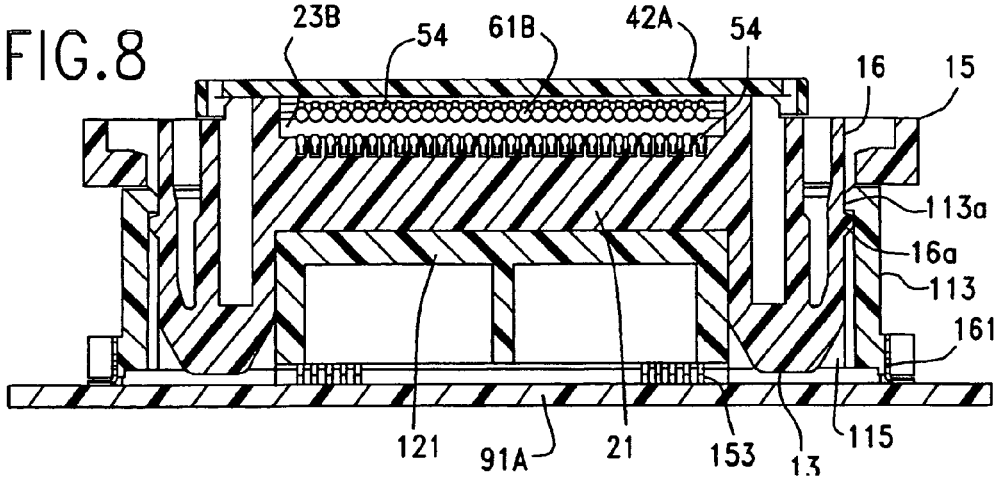
FIG. 8 is a cross sectional view of the connector assembly of FIG. 7, taken along line C-C in FIG. 7; thereof.

Further, if the fitting of the housing 11 to the counterpart connector 101 is finished, a state shown in FIGS. 6 to 8 is achieved. In other words, there is achieved a state in which the fitting convex portion 121 of the counterpart connector 101 is accommodated within the fitting concave portion 28 of the housing 11, the first outer wall portion 12A of the housing 11 enters the first outer wall portion accommodating concave portion 122A of the counterpart connector 101, the second outer wall portion 12B of the housing 11 enters the second outer wall portion accommodating concave portion 122B of the counterpart connector 101, and the side wall portions 13 of the housing 11 enter the side wall portion accommodating concave portion 115 of the counterpart connector 101.

Accordingly, the contact portion 52 of the first terminal 51A brought into contact with the first outer wall portion 12A so as to be supported comes into contact with the counterpart contact portion 152 of the counterpart terminal 151 within the first outer wall portion accommodating concave portion 122A. Further, the contact portion 52 of the second terminal 51B brought into contact with the second outer wall portion 12B so as to be supported comes into contact with the counterpart contact portion 152 of the counterpart terminal 151 within the second outer wall portion accommodating concave portion 122B. In this case, since the counterpart contact portion 152 is pressed against the contact portion 52 on the basis of the spring characteristic provided in the counterpart terminal 151 itself, the contact portion 52 and the counterpart contact portion 152 are securely in contact, and it is possible to securely maintain an electric connection state between the terminal 51 and the corresponding counterpart terminal 151.

Further, as shown in FIG. 8, the lock member 16 of the housing 11 enters the side wall portion accommodating concave portion 115 of the counterpart connector 101 together with the side wall portion 13, and the lock projection 16*a* is engaged with the counterpart lock protruding portion 113*a* in a state of being positioned in a lower side of the counterpart lock protruding portion 113*a* of the counterpart side wall portion 113. Accordingly, the housing 11 comes to a state of being locked with respect to the counterpart connector 101, and it is possible to prevent the lock member 16 from moving up with respect to the counterpart side wall portion 113, that is, prevent the housing 11 from breaking away from the counterpart connector 101.

In the case of detaching the housing 11 from the counterpart connector 101, it is possible to cancel the lock by operating the lock operation portion 15 by the operator's finger, hand or the like. The lock member 16 is constituted by the cantilever-shaped elastically deformable member having the fixed lower end, and is tilted so as to move away from the counterpart side wall portion 113 by displacing the lock operation portion 15 connected to the upper end toward the center in the width direction of the housing 11. Accordingly, the lock projection 16*a* formed in the lock member 16 moves away from the counterpart side wall portion 113, and the engagement with the counterpart lock protruding portion 113*a* is canceled. Accordingly, if the operator grips the housing 11 by hand so as to sandwich both the lock operation portions 15 from both sides, the lock is canceled, and it is possible to move up the housing 11 as it is so as to detach from the counterpart connector 101.

Further, the connector holder 41 is provided with the flexibility, and an allowable amount of a relative displacement is large between the first housing 11A held by the holding lug portions 45 connected to the first top plate portion 42A, and the second housing 11B held by the holding lug portions 45 connected to the second top plate portion 42B. Accordingly, even if the first substrate 91A and the second substrate 91B are not in a flush state, but is relatively inclined or different in the relative height, or even if the first counterpart connector 101A and the second counterpart connector 101B mounted to the first substrate 91A and the second substrate 91B are not in parallel to each other, it is possible to fit the first housing 11A and the second housing 11B in the first counterpart connector 101A and the second counterpart connector 101B.

Next, the description will be given of the operation for connecting the cables 61 to the housing 11.

Figure 9:
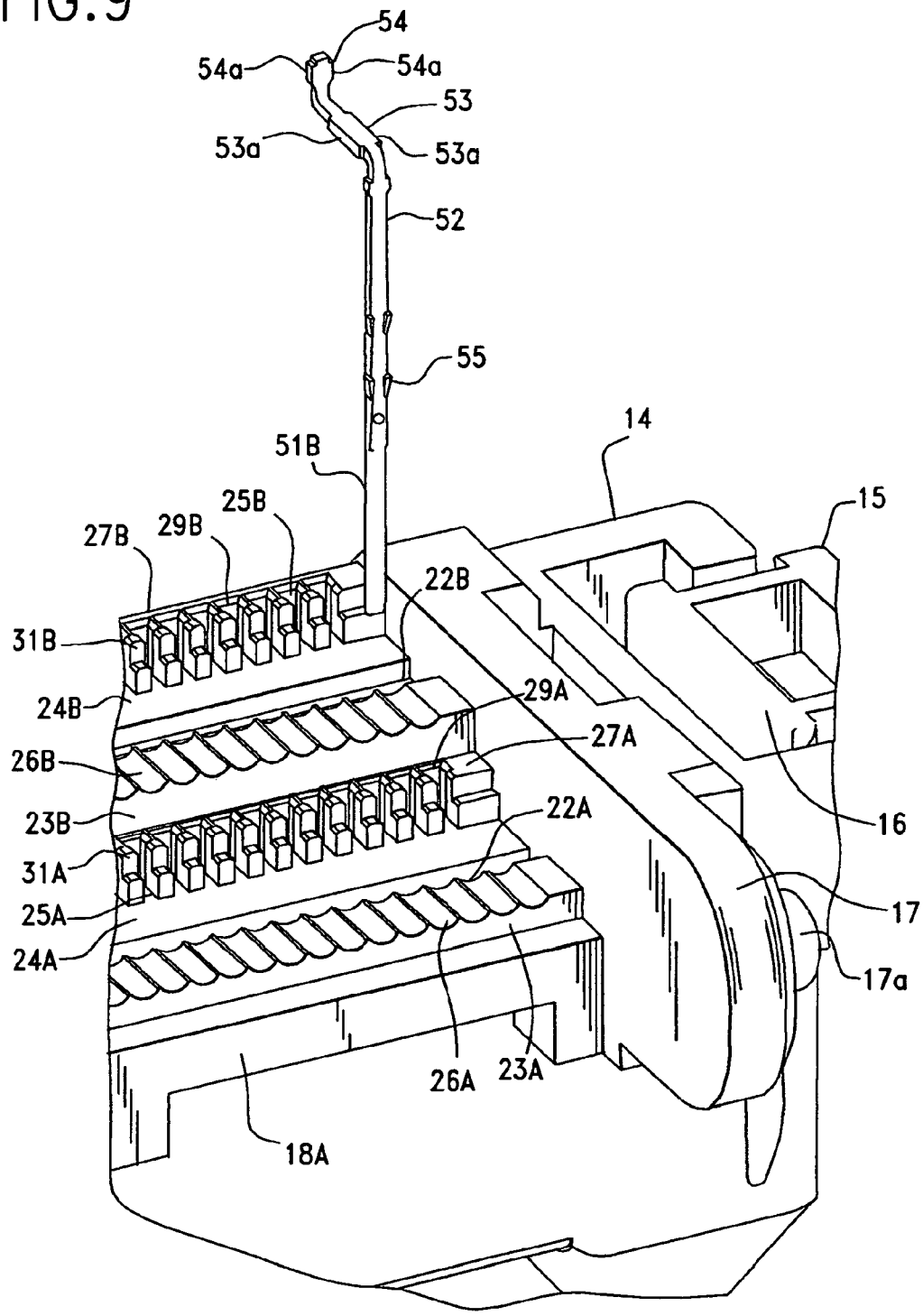
FIG. 9 is an enlarged perspective view of a main portion of the connector housing in the state before the terminals are attached.

As shown in FIG. 9, the first coating positioning concave portions 26A as a plurality of concave portions are formed in the first cable support portion 23A at a pitch corresponding to the pitch of the first cables 61A forming the ribbon cables, so as to be arranged in the width direction of the housing 11. In the same manner, the second coating positioning concave portions 26B as a plurality of concave portions are formed in the second cable support portion 23B at a pitch corresponding to the pitch of the second cables 61B forming the ribbon cables, so as to be arranged in the width direction of the housing 11.

Further, the first core wire positioning concave portions 25A formed from the first terminal support portion 24A over the first rising wall portion 27A are arranged at the pitch corresponding to the pitch of the first cables 61A in the width direction of the housing 11. In this case, each of the first core wire positioning concave portions 25A is an approximately L-shaped concave portion opening toward upward and inward (near side in FIG. 9) from the first terminal support portion 24A over the first rising wall portion 27A and having an approximately L-shaped form, which is formed by L-shaped ribs 31A formed so as to protrude at the pitch of the first cables 61A. In the same manner, the second core wire positioning concave portions 25B formed in the second rising wall portion 27B are arranged in the width direction of the housing 11 at the pitch corresponding to the pitch of the second cables 61B. In this case, each of the second core wire positioning concave portions 25B is constituted by a concave portion opening toward upward and inward and having an approximately L-shaped form, which is formed by ribs 31B.

Further, the second terminal 51B is positioned in the width direction of the housing 11, as shown in FIG. 9, by inserting the rising portion 54 into the second core wire positioning concave portion 25B from above, when the contact portion 52 is inserted into the second loading opening 22B from above. In detail, projections 54*a* protruding on both sides of the rising portion 54 are press fitted in a wide portion 29B formed along the second rising wall portion 27*b* at the back side of the second core wire positioning concave portion 25B, and is fixed and positioned in the width direction of the housing 11. In this case, in FIG. 9, the first terminal 51A (not shown) is also fixed and positioned in the width direction of the housing 11, in the same manner, by inserting the rising portion 54 into the first core wire positioning concave portion 25A from above and press fitting projections 54*a* in a wide portion 29A, when the contact portion 52 is inserted into the first loading opening 22A from above.

In accordance with the structure mentioned above, even in the case that the first and second loading openings 22A and 22B are not provided per the terminal, but are constituted by a continuous slit, it is possible to supplement the fixing in the width direction of the contact portion 52 of the first and second terminals 51A and 51B by the fixing projection 55 so as to secure the fixing of the terminal to the housing.

Further, the connection portion 53 of the terminal 51 is provided with projections 53*a* formed on both sides in the width direction. The projections 53*a* position the connection portion 53 with respect to the width direction of the housing 11 by the end portions of the ribs 31A protruding from the first terminal support portion 24A, increases a connection area in the pitch direction when the core wire 63 is connected to the connection portion 53, and can stabilize the connection.

Figure 10:
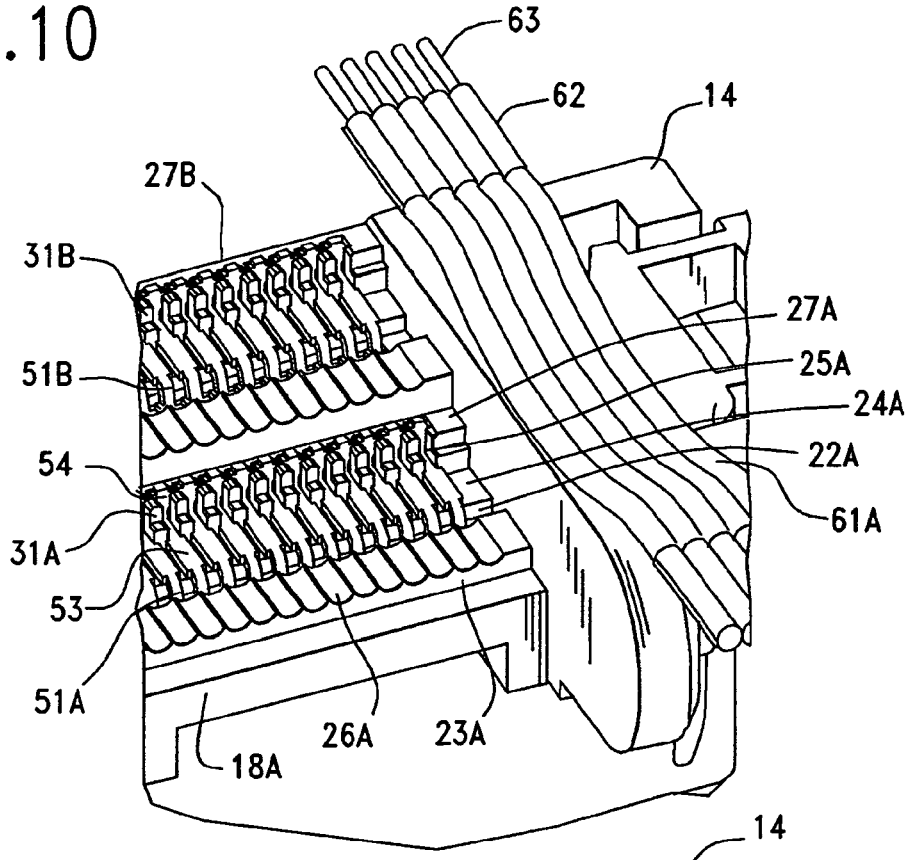
FIG. 10 is a first enlarged perspective view of the main portion of the connector, illustrating the operation for connecting the cables.

In the case of connecting the cables 61 to the housing 11, first, as shown in FIG. 10, one ends of the first cables 61A forming the ribbon cable are positioned above the first cable support portion 23A and the first terminal support portion 24A. In this case, since the number of the first cables 61A is large, several cables of the actual first cables 61A are drawn, and the others are omitted, as a matter of convenience for illustration, in the embodiment shown in FIGS. 10 to 13.

Figure 11:
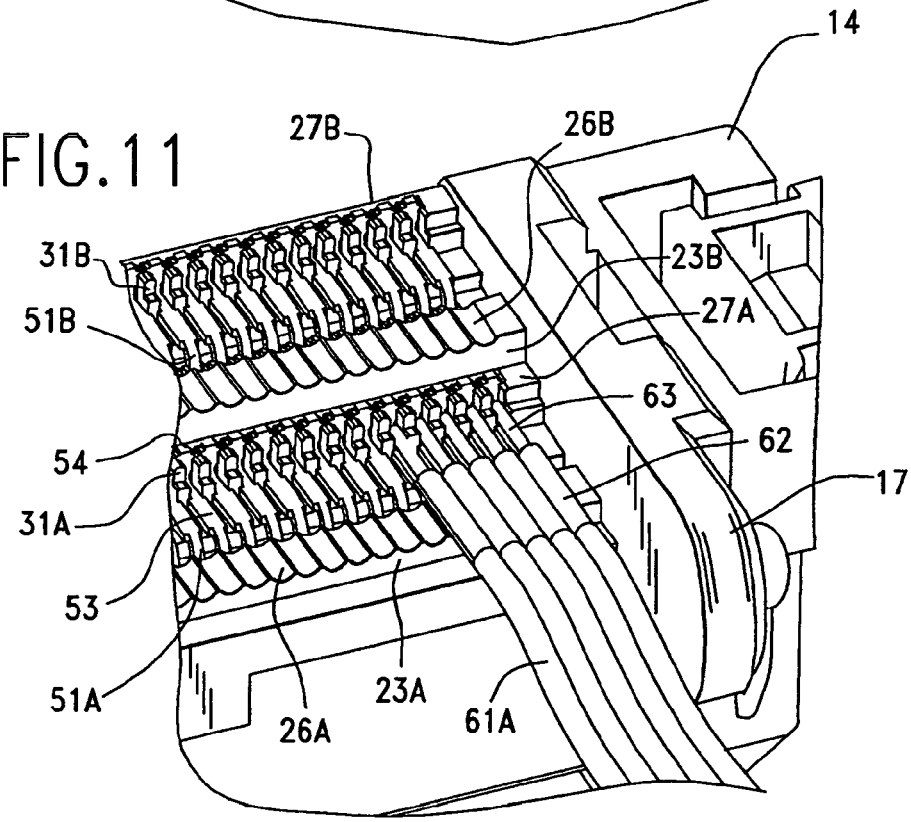
FIG. 11 is a second, sequential view of FIG. 10, illustrating the orienting of the cables.
Figure 14:
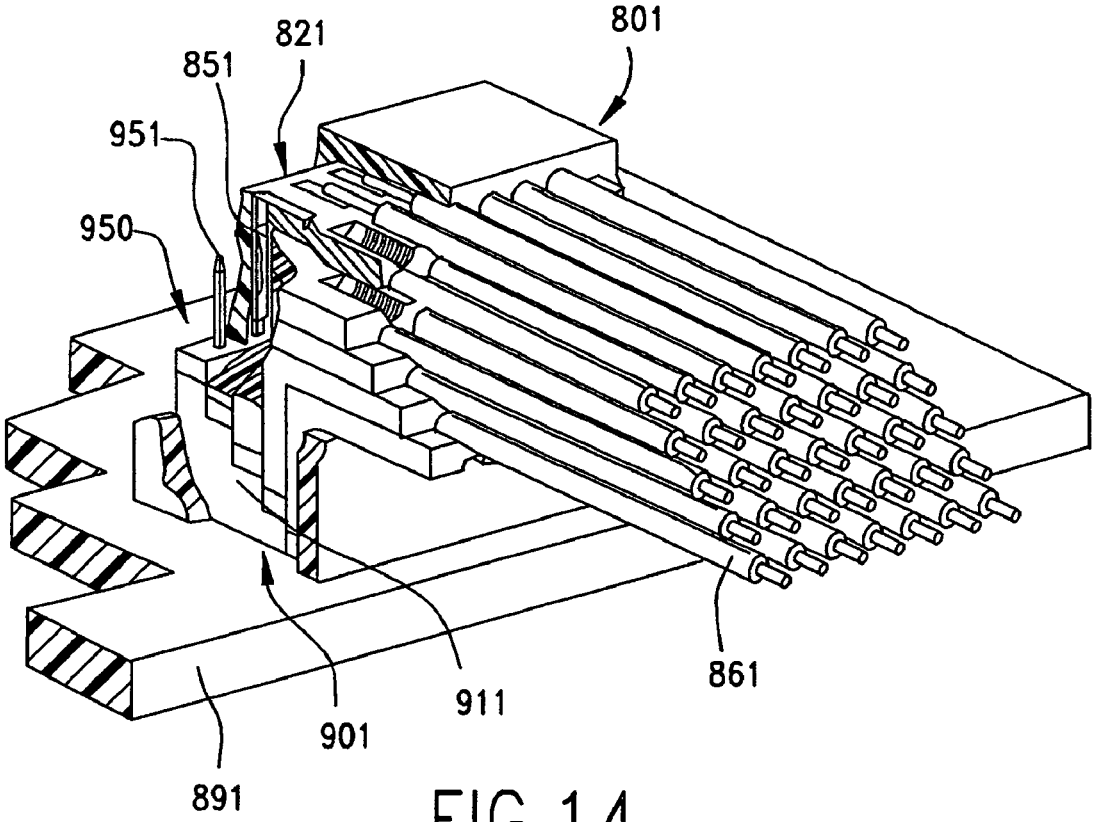
FIG.14 (Prior art)
FIG. 14 is a side elevational view of a conventional cable connector.

Subsequently, the first cables 61A are moved down, as shown in FIG. 11, and in the end portions of the first cables 61A, the core wires 63 in which the coating members 62 are removed so as to be exposed are mounted to the connection portions 53 of the first terminals 51A on the first terminal support portion 24A, and the end portions of the portions covered by the coating members 62, that is, the adjacent portions of the exposed core wires 63 are mounted to the first cable support portion 23A. In this case, since the leading end of the core wire 63 is accommodated in the first core wire positioning concave portion 25A, and the end portion of the portion covered by the coating member 62 is accommodated in the first coating positioning concave portion 26A, it is possible to easily and securely position the first cable 61A with respect to the width direction of the housing 11. Further, the positioning of the first cable 61A with respect to the axial direction is executed by moving the first cable 61A toward the outer side (back side in FIG. 11), and bringing the leading end of the core wire 63 into abutment against the rising portion 54.

The positioning mentioned above can be simultaneously executed in all the first cables 61A by integrally handling the whole of the first cables 61A forming the ribbon cable. Accordingly, the operator can easily and accurately position all the first cables 61A by using the finger, the hand and the like of the single hand.

Further, since the leading end portions of the core wires 63 enter between the ribs 31A and the ribs 31B, that is, into the first core wire positioning concave portions 25A and second core wire positioning concave portions 25B, respectively, it is possible to securely prevent the short circuit between the adjacent core wires.

Subsequently, the core wire 63 of the first cable 61A is firmly fixed and connected to the connection portion 53 by the fixing means such as the soldering or the like. In this case, it is possible to solder the core wire 63 to the connection portion 53, for example, by previously coating the solder around the core wire 63, bringing a heating member such as a heater or the like into contact with the core wire 63 mounted on the connection portion 53, and pressing the core wire 63 while heating. In this case, the heating member is desirably structured such that the portion brought into contact with the core wire 63 is formed in an elongated band-like shape extending in the width direction of the housing 11 and is provided with such a dimension as to be simultaneously brought into contact with all the arranged core wires 63 without coming into contact with the first rising wall portion 27A and the coating members 62. Accordingly, it is possible to simultaneously solder all the core wires 63 to the connection portions 53. Further, since all the first cables 61A are positioned in the width direction and the axial direction of the housing 11, and come to a state of being aligned with the connection portions 53, the first rising wall portion 27A and the coating members 62 can be prevented from coming into contact with the heating member so as to be molten, by bringing the heating member into contact with the core wire 63 in a state of positioning the heating member with respect to the connection portion 53 arranged in the width direction of the housing 11. Further, since the operator can position all the first cables 61A by the single hand, it is possible to easily and accurately execute the soldering work by keeping the first cable 61A in the positioned state by one hand and operating the heating member by the other hand.

In this manner, when the core wires 63 of the first cables 61A are connected to the connection portions 53, and the connection of the first cables 61A to the housing 11 is finished, as mentioned above, the second cables 61B are subsequently connected to the housing 11.

In this case, as shown in FIG. 12, one ends of the second cables 61B forming the ribbon cable are positioned above the second cable support portion 23B and the second terminal support portion 24B. In this case, since the number of the second cables 61B is large, several cables of the actual second cables 61B are drawn and the other cables are omitted, as a matter of convenience for illustration, in the embodiment shown in FIGS. 12 and 13.

Subsequently, the second cables 61B are moved down, as shown in FIG. 13, and in the end portions of the second cables 61B, the core wires 63 in which the coating members 62 are removed so as to be exposed are mounted to the connection portions 53 of the second terminal 51B on the second terminal support portion 24B, and the end portions of the portions covered by the coating members 62, that is, the adjacent portions of the exposed core wires 63 are mounted to the second cable support portion 23B. In this case, since the leading end of the core wire 63 is accommodated in the second core wire positioning concave portion 25B, and the end portion of the portion covered by the coating member 62 is accommodated in the second coating positioning concave portion 26B, it is possible to easily and securely position the second cable 61B with respect to the width direction of the housing 11. Further, the positioning of the second cable 61B with respect to the axial direction is executed by moving the second cable 61B toward the outer side (the back side in FIG. 13), and bringing the leading end of the core wire 63 into abutment against the rising portion 54.

The positioning mentioned above can be simultaneously executed in all the second cables 61B by integrally handling the whole of the second cables 61B forming the ribbon cable, in the same manner as the case of the first cable 61A. Accordingly, the operator can easily and accurately position all the second cables 61B by using the finger, the hand and the like of the single hand.

Subsequently, the core wires 63 of the second cables 61B are firmly fixed and connected to the connection portions 53 by the fixing means such as the soldering or the like. In this case, it is possible to easily and accurately execute the soldering work by applying the same manner as the case of the first cables 61A. As mentioned above, the core wires 63 of the second cables 61B are connected to the connection portions 53, and the connection of the second cables 61B to the housing 11 is finished.

As mentioned above, in the present embodiment, the connection portions 53 of the first terminal 51A and the second terminal 51B are arranged so as to generate height difference, the first coating positioning concave portions 26A and the second coating positioning concave portions 26B are formed in the upper surfaces of the first cable support portion 23A and the second cable support portion 23B formed at the positions adjacent to the connection portions 53, the end portions of the first cables 61A and the second cables 61B covered by the coating members 62 are accommodated in the first coating positioning concave portions 26A and the second coating positioning concave portions 26B so as to be positioned in the width direction of the housing 11, and the positioning with respect to the axial direction is executed by bringing the leading ends of the core wires 63 into abutment against the rising portions 54 of the first terminals 51A and the second terminals 51B.

Accordingly, it is possible to integrally handle all of the first cables 61A and all of the second cables 61B forming the ribbon cables, and simultaneously position all the first cables 61A and the second cables 61B. Accordingly, it is possible to easily and accurately position all the first cable 61A and the second cable 61B. Further, since the leading ends of the core wires 63 are protected by the rising portions 54, the leading ends of the core wires 63 will not be deformed or wind due to an application of the external force.

Further, the housing 11 is provided with the first core wire positioning concave portions 25A and the second core wire positioning concave portions 25B, the rising portions 54 of the first terminals 51A and the second terminals 51B are accommodated in the first core wire positioning concave portions 25A and the second core wire positioning concave portions 25B so as to be supported to the first rising wall portion 27A and the second rising wall portion 27B, and the leading ends of the core wires 63 are accommodated in the first core wire positioning concave portions 25A and the second core wire positioning concave portions 25B so as to be positioned in the width direction of the housing 11. Accordingly, it is possible to easily and accurately position the first terminals 51A and the second terminals 51B. Further, even if the leading ends of the core wires 63 are brought into abutment against the rising portions 54, the rising portions 54 do not deform. Further, since the leading ends of the core wires 63 are positioned, it is possible to more accurately position the first cables 61A and the second cables 61B.

In this case, in the present embodiment, the description is given of the case that the cables 61 are constituted by two sets, that is, the first cables 61A and the second cables 61B, and the terminals 51 are constituted by two set, that is, the first terminals 51A and the second terminals 51B, however, the number of the sets of the cables 61 and the terminals 51 may employ any number as far as it is plural numbers, and may be set to three sets or more. In this case, the sets of the rising wall portions 27, the core wire positioning concave portions 25, the coating positioning concave portions 26 and the like are set to the same number as the set of the cable 61 and the set of the terminal 51.

The present invention is not limited to the above-described embodiments, and may be changed in various ways based on the gist of the present invention, and these changes are not eliminated from the scope of the present invention.

What is claimed is:

1. A floating connector comprising:

a pair of housings each including a plurality of sets of conductive terminals, and adapted to fit with a counterpart mating connector;

a plurality of cables connecting the terminals of one housing to the terminals of the other housing; and a connector holder flexibly coupling the one and the other housing together in a manner so as to be relatively displaceable and wherein each of the terminals includes a contact portion coming into contacting with a counterpart terminal in the mating connector, a connection portion with one end connected to an upper end of the contact portion and to which a wire of the cable is connected, and a rising portion having a lower end connected to the other end of the connection portion and against which a free end of the wire abuts, the terminals of each set being aligned in a widthwise along the housing, said terminal connection portions of the adjacent terminal sets having a height difference formed there between;

each connector housing including a plurality of cable support portions formed at positions adjacent to said terminal connection portions and a plurality of concave portions formed on upper surfaces of the cable support portions, aligned in the widthwise along the housing, and accommodating said cables therein each cable further including an exposed free end from which cable insulation is removed and a conductor thereof exposed, said cables being aligned widthwise along the housing, said cables being arranged at vertically different positions, the cable insulation of the said cables being received in the concave portions and positioned widthwise along of the housing, the free ends of said wires brought into abutment against the rising portions and positioned in an axial direction, and said free ends being connected to said terminal connection portions.

2. The floating connector of claim 1, wherein each of said housings include a rising wall portion formed in an upper end thereof, and a plurality of positioning concave portions formed therein;

said terminal rising portions being received in the positioning concave portions and supported by said rising wall portion; and said wire free ends being received in said positioning concave portions and positioned widthwise along said housing.

3. The floating connector of claim 1, wherein said cables include lengths of ribbon cable in which adjacent cables are fixed to each other.

4. The floating connector of claim 1, wherein said terminals are arranged in at least two distinct sets whereas positions of the two cable sets differ axial by lengthwise direction of said cable.

5. The floating connector of claim 1, wherein said connector holder includes a first top plate portion covering an upper side of said one connector housing, a second top plate portion separated from the first top plate portion and covering an upper side of said connector other housing, coupling side wall portions connected at their ends to distal ends of said first top plate portion and said second top plate portion, and holding lug portions connected to proximal ends of said first top plate portion and the second top plate portion and holding the housings.

6. The floating connector of claim 5, wherein said two connector housings include holding wall portions formed at both sides of said connector housings in the width direction, and holding projections formed in the holding wall portions; and said connector holder includes engagement openings formed in the holding lug portions, said holding lug portions sandwich the holding wall portions, and said engagement openings are engaged with said holding projection.

* * * * *